US010174445B2

(12) United States Patent
Brunton et al.

(10) Patent No.: US 10,174,445 B2
(45) Date of Patent: Jan. 8, 2019

(54) WOVEN FABRIC-LIKE JACQUARD FABRIC FOR MATTRESS TICKING AND METHOD FOR KNITTING THE SAME

(71) Applicant: MONARCH KNITTING MACHINERY (U.K.) LTD., Leicester (GB)

(72) Inventors: David Brunton, Leicester (GB); Kimberley Hodgson, Leicester (GB); Helen Martin, Leicester (GB)

(73) Assignee: MONARCH KNITTING MACHINERY (UK) LTD., Leicester (GB)

( * ) Notice: Subject to any disclaimer, the term of this patent is extended or adjusted under 35 U.S.C. 154(b) by 165 days.

(21) Appl. No.: 15/346,429

(22) Filed: Nov. 8, 2016

(65) Prior Publication Data

US 2017/0130376 A1 May 11, 2017

(30) Foreign Application Priority Data

Nov. 9, 2015 (JP) ..... 2015-219843

(51) Int. Cl.
*D04B 1/12* (2006.01)
*D04B 9/38* (2006.01)
*D04B 1/10* (2006.01)

(52) U.S. Cl.
CPC ..... *D04B 9/38* (2013.01); *D04B 1/102* (2013.01); *D04B 1/123* (2013.01); *D10B 2403/023* (2013.01); *D10B 2503/06* (2013.01)

(58) Field of Classification Search
CPC . D04B 1/10; D04B 1/102; D04B 9/06; D04B 9/08; D04B 9/26
See application file for complete search history.

(56) References Cited

U.S. PATENT DOCUMENTS 3,986,374 A * 10/1976 Fane ..... D04B 1/102 442/313
3,990,268 A * 11/1976 Smith ..... D04B 1/02 66/9 R (Continued)

FOREIGN PATENT DOCUMENTS

DE 202009007561 U1 8/2009
EP 1 348 788 A1 10/2003

(Continued)

OTHER PUBLICATIONS

Search Report for European Application No. 16 19 7077 dated Apr. 18, 2017.

(Continued)

*Primary Examiner* — Danny Worrell
(74) *Attorney, Agent, or Firm* — Alston & Bird LLP

(57) ABSTRACT

A jacquard fabric for a mattress ticking to be used for a bedding mattress and a method for knitting this jacquard fabric are provided. The method according to the present invention is a method for producing a jacquard fabric for a mattress ticking using a double-sided needle selection circular knitting machine of a rib gating type, the method by which a suitable pattern is created by means of computer-based needle selection on a cylinder side, a suitable pattern is also created by means of computer-based needle selection on a dial side, and a suitable knitting structure is made in a suitable part by combining the pattern obtained on the cylinder side with the pattern obtained on the dial side. As a result of employing an irregular twill pattern as a background knitting structure serving as a base, a stretchable fabric that has a soft texture, a tight knitting structure, and similar strength to woven fabric is obtained.

20 Claims, 13 Drawing Sheets

(56) References Cited

U.S. PATENT DOCUMENTS

| | | | | | |
|---|---|---|---|---|---|
| 4,125,001 | A * | 11/1978 | Bryars | D04B 1/04 | 66/190 |
| RE30,638 | E * | 6/1981 | Bryars | D04B 9/16 | 66/191 |
| 5,027,618 | A * | 7/1991 | Robinson | D04B 1/126 | 66/195 |
| 5,299,435 | A * | 4/1994 | Whalley | D04B 1/123 | 66/190 |
| 6,622,528 | B2 * | 9/2003 | Masse | D04B 9/28 | 66/196 |
| 7,536,879 | B2 * | 5/2009 | Vanwelden | D04B 1/126 | 66/19 |
| 8,640,503 | B2 * | 2/2014 | Kunde | D04B 1/104 | 66/25 |
| 9,732,451 | B2 * | 8/2017 | Lee | D04B 1/104 | |
| 2008/0236204 | A1 * | 10/2008 | Vanwelden | D04B 1/126 | 66/17 |

FOREIGN PATENT DOCUMENTS

| | | | |
|---|---|---|---|
| EP | 1 975 294 | A1 | 10/2008 |
| GB | 2 233 989 | A | 1/1991 |
| JP | 2003 286636 | A | 10/2003 |

OTHER PUBLICATIONS

Extended European Search Report for corresponding European Application No. 17187445.6 dated Mar. 23, 2018, 3 pages.

* cited by examiner

FIG. 1A EMBODIMENT 1: BACKGROUND STRUCTURE
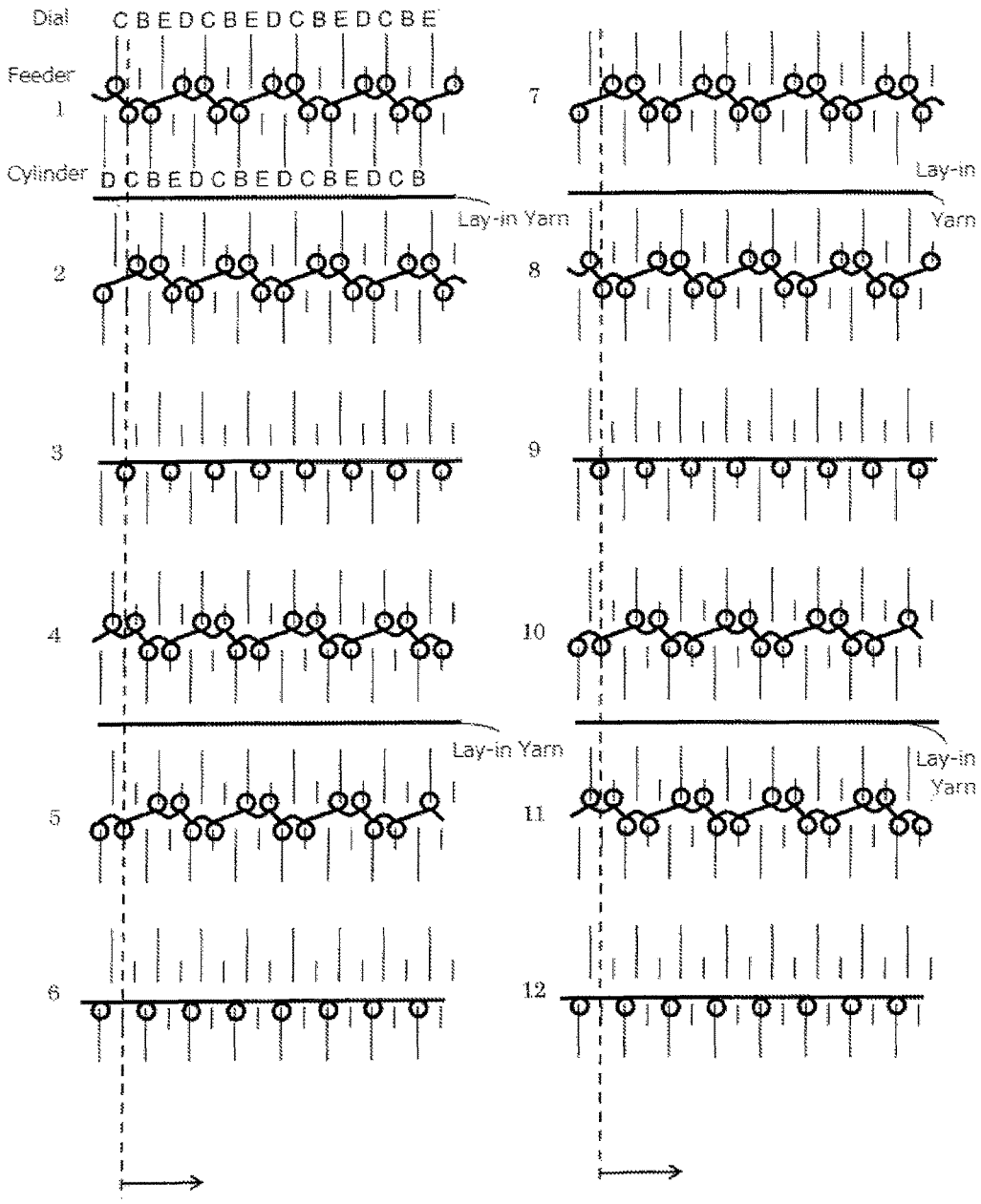

EMBODIMENT 1: JACQUARD FABRIC

FIG. 2A

Cylinder Side

| | | | | | | | | | | | | |
|---|---|---|---|---|---|---|---|---|---|---|---|---|
| 12 | X | – | X | – | X | – | X | – | X | – | X | – |
| 11 | – | – | X | X | – | – | X | X | – | – | X | X |
| 10 | X | X | – | – | X | X | – | – | X | X | – | – |
| 9 | – | X | – | X | – | X | – | X | – | X | – | X |
| 8 | – | X | X | – | – | X | X | – | – | X | X | – |
| 7 | X | – | – | X | X | – | – | X | X | – | – | X |
| 6 | X | – | X | – | X | – | X | – | X | – | X | – |
| 5 | X | X | – | – | X | X | – | – | X | X | – | – |
| 4 | – | – | X | X | – | – | X | X | – | – | X | X |
| 3 | – | X | – | X | – | X | – | X | – | X | – | X |
| 2 | X | – | – | X | X | – | – | X | X | – | – | X |
| Feeder No. 1 | – | X | X | – | – | X | X | – | – | X | X | – |
| | D | C | B | E | D | C | B | E | D | C | B | E |

X: Knit

–: Welt

Dial Side

| | | | | | | | | | | | | |
|---|---|---|---|---|---|---|---|---|---|---|---|---|
| 12 | – | – | – | – | – | – | – | – | – | – | – | – |
| 11 | X | X | – | – | X | X | – | – | X | X | – | – |
| 10 | – | – | X | X | – | – | X | X | – | – | X | X |
| 9 | – | – | – | – | – | – | – | – | – | – | – | – |
| 8 | X | – | – | X | X | – | – | X | X | – | – | X |
| 7 | – | X | X | – | – | X | X | – | – | X | X | – |
| 6 | – | – | – | – | – | – | – | – | – | – | – | – |
| 5 | – | – | X | X | – | – | X | X | – | – | X | X |
| 4 | X | X | – | – | X | X | – | – | X | X | – | – |
| 3 | – | – | – | – | – | – | – | – | – | – | – | – |
| 2 | – | X | X | – | – | X | X | – | – | X | X | – |
| Feeder No. 1 | X | – | – | X | X | – | – | X | X | – | – | X |
| | C | B | E | D | C | B | E | D | C | B | E | D |

X: Knit

–: Welt

FIG. 2B

Cylinder Side

| Feeder No. | D | C | B | E | D | C | B | E | D | C | B | E |
|---|---|---|---|---|---|---|---|---|---|---|---|---|
| 12 | X | – | X | – | – | – | – | – | – | – | X | – |
| 11 | – | – | X | X | – | – | X | X | – | – | X | X |
| 10 | X | X | – | – | X | X | – | – | X | X | – | – |
| 9 | – | X | – | – | – | – | – | – | – | – | – | X |
| 8 | – | X | X | – | – | X | X | – | – | X | X | – |
| 7 | X | – | – | X | X | – | – | X | X | – | – | X |
| 6 | X | – | X | – | – | – | – | – | – | – | X | – |
| 5 | X | X | – | – | X | X | – | – | X | X | – | – |
| 4 | – | – | X | X | – | – | X | X | – | – | X | X |
| 3 | – | X | – | X | – | – | – | – | – | – | – | – |
| 2 | X | – | – | X | X | – | – | X | X | – | – | X |
| 1 | – | X | X | – | – | X | X | – | – | X | X | – |

X: Knit

–: Welt

Dial Side

| Feeder No. | C | B | E | D | C | B | E | D | C | B | E | D |
|---|---|---|---|---|---|---|---|---|---|---|---|---|
| 12 | – | – | – | – | X | – | X | – | X | – | – | – |
| 11 | X | X | – | – | – | – | – | – | – | – | – | – |
| 10 | – | – | X | – | – | – | – | – | – | – | X | X |
| 9 | – | – | – | X | – | X | – | X | – | X | – | – |
| 8 | X | – | – | – | – | – | – | – | – | – | – | X |
| 7 | – | X | X | – | – | – | – | – | – | – | X | – |
| 6 | – | – | – | – | X | – | X | – | X | – | – | – |
| 5 | – | – | X | X | – | – | – | – | – | – | X | – |
| 4 | X | X | – | – | – | – | – | – | – | – | – | – |
| 3 | – | – | – | – | – | X | – | X | – | X | – | X |
| 2 | – | X | X | – | – | – | – | – | – | – | – | – |
| 1 | X | – | – | X | X | – | – | – | – | – | – | – |

: Jacquard Fabric

X: Knit

–: Welt

FIG. 4A COMPARATIVE EXAMPLE 1: BACKGROUND STRUCTURE
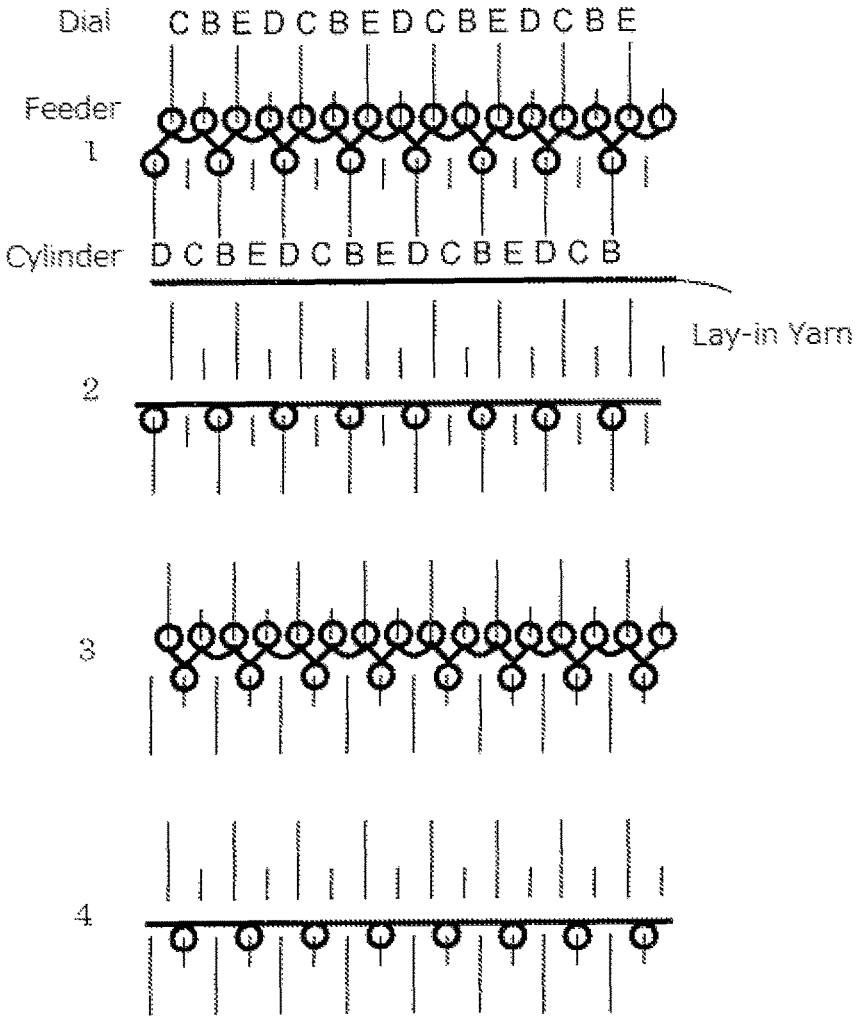

COMPARATIVE EXAMPLE 1: JACQUARD FABRIC

FIG. 5A

Cylinder Side

| Feeder No. | | | | | | | | | | | | |
|---|---|---|---|---|---|---|---|---|---|---|---|---|
| 4 | – | X | – | X | – | X | – | X | – | X | – | X |
| 3 | – | X | – | X | – | X | – | X | – | X | – | X |
| 2 | X | – | X | – | X | – | X | – | X | – | X | – |
| 1 | X | – | X | – | X | – | X | – | X | – | X | – |
| | D | C | B | E | D | C | B | E | D | C | B | E |

X: Knit
–: Welt

Dial Side

| Feeder No. | | | | | | | | | | | | |
|---|---|---|---|---|---|---|---|---|---|---|---|---|
| | – | – | – | – | – | – | – | – | – | – | – | – |
| 3 | X | X | X | X | X | X | X | X | X | X | X | X |
| 2 | – | – | – | – | – | – | – | – | – | – | – | – |
| 1 | X | X | X | X | X | X | X | X | X | X | X | X |
| | C | B | E | D | C | B | E | D | C | B | E | D |

X: Knit
–: Welt

FIG. 5B

Cylinder Side

| Feeder No. | D | C | B | E | D | C | B | E | D | C | B | E |
|---|---|---|---|---|---|---|---|---|---|---|---|---|
| 8 | – | X | – | X | – | X | – | X | – | X | – | X |
| 7 | – | X | – | X | – | X | – | X | – | X | – | X |
| 6 | X | – | X | – | X | – | X | – | X | – | X | – |
| 5 | X | – | X | – | X | – | X | – | X | – | X | – |
| 4 | – | X | – | X | – | X | – | X | – | X | – | X |
| 3 | – | X | – | X | – | X | – | X | – | X | – | X |
| 2 | X | – | X | – | X | – | X | – | X | – | X | – |
| 1 | X | – | X | – | X | – | X | – | X | – | X | – |

X: Knit

–: Welt

Dial Side

| Feeder No. | C | B | E | D | C | B | E | D | C | B | E | D |
|---|---|---|---|---|---|---|---|---|---|---|---|---|
| 8 | – | – | – | – | – | – | – | – | – | – | – | – |
| 7 | X | X | X | X | X | X | – | – | – | – | – | – |
| 6 | – | – | – | – | – | – | – | X | – | X | – | X |
| 5 | X | X | X | X | X | X | – | – | – | – | – | – |
| 4 | – | – | – | – | – | – | – | – | – | – | – | – |
| 3 | X | X | X | X | X | X | – | – | – | – | – | – |
| 2 | – | – | – | – | – | – | X | – | X | – | X | – |
| 1 | X | X | X | X | X | X | – | – | – | – | – | – |

Jacquard Fabric

X: Knit

–: Welt

FIG. 6A COMPARATIVE EXAMPLE 2: BACKGROUND STRUCTURE
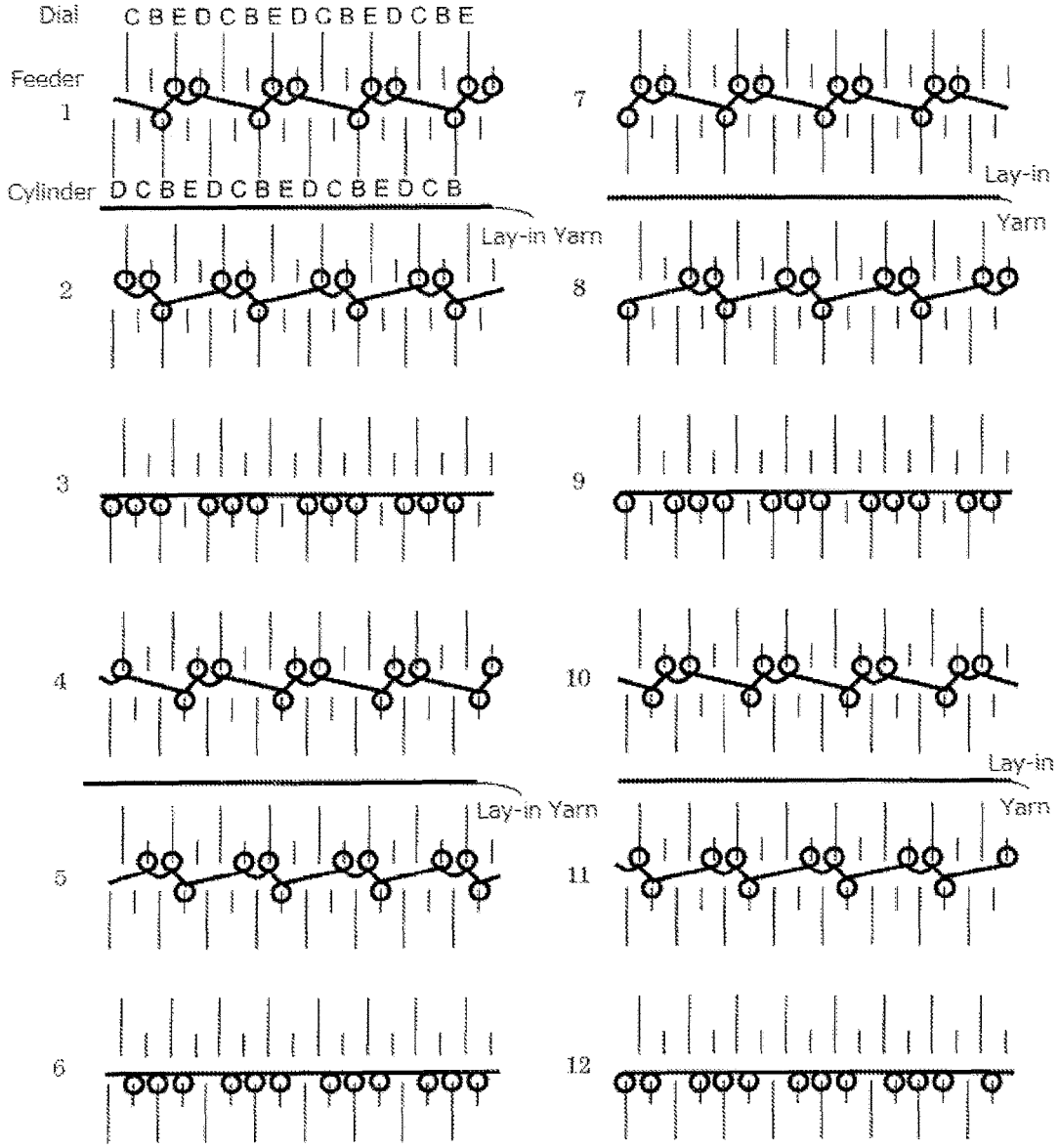

FIG. 6B COMPARATICE EXAMPLE 2: JACQUARD FABRIC
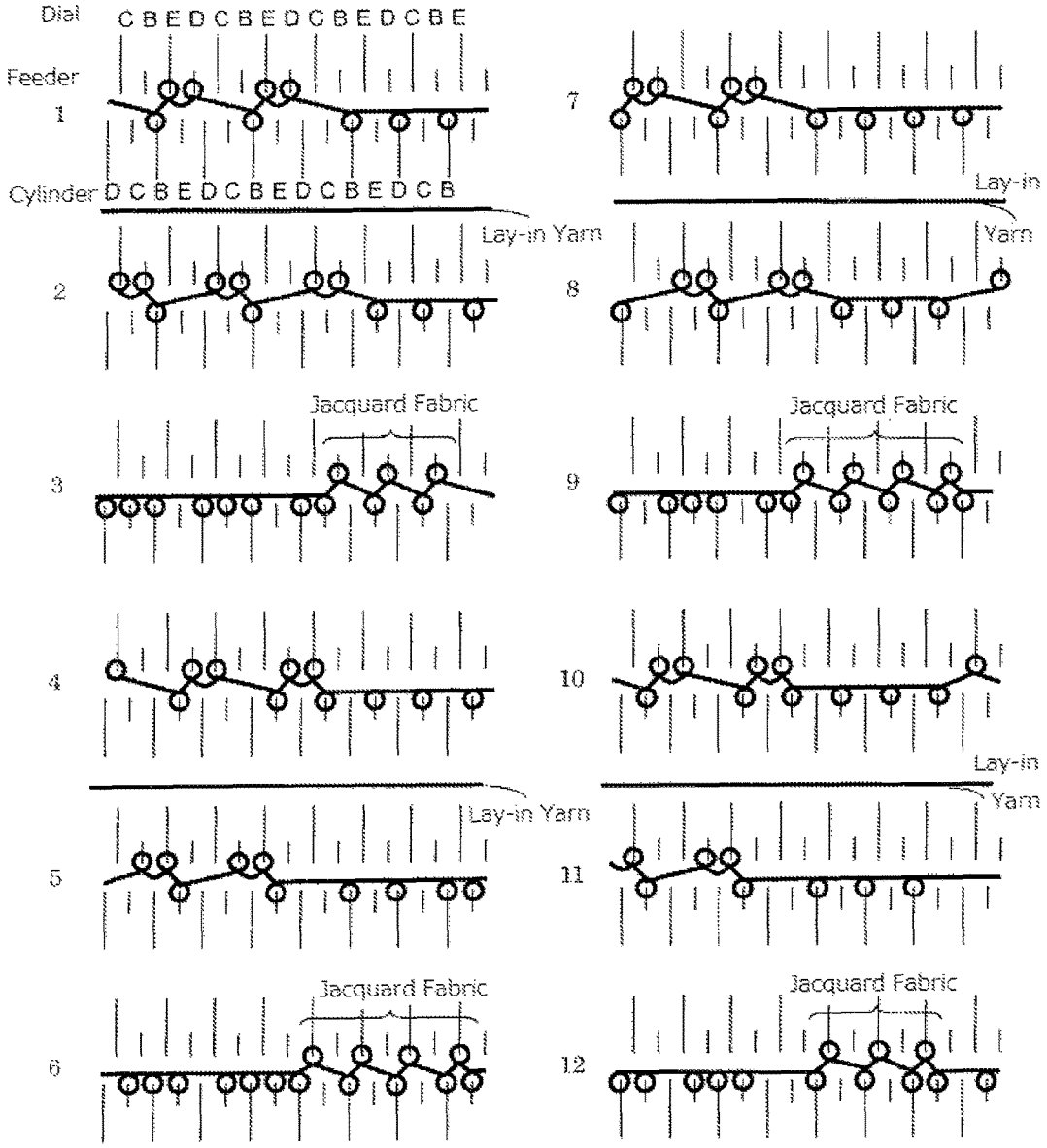

FIG. 7A

Cylinder Side

| Feeder No. | D | C | B | E | D | C | B | E | D | C | B | E |
|---|---|---|---|---|---|---|---|---|---|---|---|---|
| 12 | X | X | – | X | X | X | – | X | X | X | – | X |
| 11 | – | X | – | – | – | X | – | – | – | X | – | – |
| 10 | – | X | – | – | – | X | – | – | – | X | – | – |
| 9 | X | – | X | X | X | – | X | X | X | – | X | X |
| 8 | X | – | – | – | X | – | – | – | X | – | – | – |
| 7 | X | – | – | – | X | – | – | – | X | – | – | – |
| 6 | – | X | X | X | – | X | X | X | – | X | X | X |
| 5 | – | – | – | X | – | – | – | X | – | – | – | X |
| 4 | – | – | – | X | – | – | – | X | – | – | – | X |
| 3 | X | X | X | – | X | X | X | – | X | X | X | – |
| 2 | – | – | X | – | – | – | X | – | – | – | X | – |
| 1 | – | – | X | – | – | – | X | – | – | – | X | – |

X: Knit
–: Welt

Dial Side

| Feeder No. | C | B | E | D | C | B | E | D | C | B | E | D |
|---|---|---|---|---|---|---|---|---|---|---|---|---|
| 12 | – | – | – | – | – | – | – | – | – | – | – | – |
| 11 | X | – | – | X | X | – | – | X | X | – | – | X |
| 10 | – | X | X | – | – | X | X | – | – | X | X | – |
| 9 | – | – | – | – | – | – | – | – | – | – | – | – |
| 8 | – | – | X | X | – | – | X | X | – | – | X | X |
| 7 | X | X | – | – | X | X | – | – | X | X | – | – |
| 6 | – | – | – | – | – | – | – | – | – | – | – | – |
| 5 | – | X | X | – | – | X | X | – | – | X | X | – |
| 4 | X | – | – | X | X | – | – | X | X | – | – | X |
| 3 | – | – | – | – | – | – | – | – | – | – | – | – |
| 2 | X | X | – | – | X | X | – | – | X | X | – | – |
| 1 | – | – | X | X | – | – | X | X | – | – | X | X |

X: Knit
–: Welt

FIG. 7B

Cylinder Side

| Feeder No. | D | C | B | E | D | C | B | E | D | C | B | E | D | C | B | E |
|---|---|---|---|---|---|---|---|---|---|---|---|---|---|---|---|---|
| 12 | X | X | – | X | X | X | – | – | X | – | X | – | X | X | – | X |
| 11 | – | X | – | – | – | X | – | – | X | – | X | – | X | – | – | – |
| 10 | – | X | – | – | – | X | – | X | – | X | – | X | – | X | – | – |
| 9 | X | – | X | X | X | – | X | X | – | X | – | X | – | X | X | – |
| 8 | X | – | – | – | X | – | – | – | – | X | – | X | – | X | – | – |
| 7 | X | – | – | – | X | – | – | – | X | – | X | – | X | – | X | – |
| 6 | – | X | X | X | – | X | X | X | X | – | X | – | X | – | X | X |
| 5 | – | – | – | X | – | – | – | X | – | – | X | – | X | – | X | X |
| 4 | – | – | – | X | – | – | – | X | – | X | – | X | – | X | – | X |
| 3 | X | X | X | – | X | X | X | – | X | X | – | X | – | X | – | – |
| 2 | – | – | X | – | – | – | X | – | – | – | – | X | – | X | – | X |
| 1 | – | – | X | – | – | – | X | – | – | – | X | – | X | – | X | – |

X: Knit
–: Welt

Dial Side

| Feeder No. | C | B | E | D | C | B | E | D | C | B | E | D | C | B | E | D |
|---|---|---|---|---|---|---|---|---|---|---|---|---|---|---|---|---|
| 12 | – | – | – | – | – | – | – | – | X | – | X | – | X | – | – | – |
| 11 | X | – | X | X | – | – | – | – | – | – | – | – | – | – | – | – |
| 10 | – | X | X | – | – | X | X | – | – | – | – | – | – | – | X | – |
| 9 | – | – | – | – | – | – | – | X | – | X | – | X | – | X | – | – |
| 8 | – | – | X | X | – | – | X | X | – | – | – | – | – | – | – | – |
| 7 | X | X | – | – | X | X | – | – | – | – | – | – | – | – | – | – |
| 6 | – | – | – | – | – | – | – | – | X | – | X | – | X | – | X | – |
| 5 | – | X | X | – | – | X | X | – | – | – | – | – | – | – | – | – |
| 4 | X | – | – | X | X | – | – | X | X | – | – | – | – | – | – | – |
| 3 | – | – | – | – | – | – | – | – | – | X | – | X | – | X | – | – |
| 2 | X | X | – | – | X | X | – | – | X | X | – | – | – | – | – | – |
| 1 | – | – | X | X | – | – | X | X | – | – | – | – | – | – | – | – |

Jacquard Fabric
X: Knit
–: Welt

WOVEN FABRIC-LIKE JACQUARD FABRIC FOR MATTRESS TICKING AND METHOD FOR KNITTING THE SAME

BACKGROUND OF THE INVENTION

1. Field of the Invention

The present invention relates to double-sided jacquard fabrics, and relates more particularly to a jacquard fabric for a mattress ticking (which is called a "bed cover" in Japan) used for a bedding mattress, and a method for knitting this jacquard fabric.

2. Description of Related Art

Regarding conventional techniques for jacquard fabrics knitted with general double-sided needle selection circular knitting machines and methods for knitting such jacquard fabrics, for example, "a jacquard spacer fabric and a knitting method thereof" disclosed in JP 2003-286636A (corresponding European Application; EP1348788(A1)) is known.

This conventional technique publication describes a fabric having at least one of: (a) a knit welt 1×1 long stitch jacquard pattern; (b) a knit tack 1×1 pique long stitch jacquard pattern; and (c) a knit welt jacquard pattern of at least two colors appearing on the front surface of the fabric, and a method for manufacturing such fabric.

The fabric described in JP 2003-286636A is a spacer fabric, which is too thick and does not have a soft texture, and is thus not suitable for a mattress ticking fabric used for a bedding mattress. For a mattress ticking, a stretchable fabric that has a soft texture, a tight knitting structure, and similar body to woven fabric is desired.

SUMMARY OF THE INVENTION

The present invention has been made to solve the foregoing problem, and aims to provide a jacquard fabric for a mattress ticking to be used for a bedding mattress, and a method for knitting this jacquard fabric.

The inventors knitted a variety of fabrics through trial and error in order to obtain a fabric suitable for a jacquard fabric for a mattress ticking, and reached the present invention.

The present invention is a method for producing a background structure in a jacquard fabric for a mattress ticking using a double-sided needle selection circular knitting machine of a rib gating type, the method by which a suitable pattern is created by means of computer-based needle selection on a cylinder side, a suitable pattern is also created by means of computer-based needle selection on a dial side, and a suitable knitting structure is made in a suitable part by combining the pattern obtained on the cylinder side with the pattern obtained on the dial side, the method including:

in a course direction from a needle serving as a reference (e.g., the position indicated by dotted lines in FIGS. 1A and 2A), at a first feeder, repeating a process of knitting with two consecutive cylinder needles, welting with one opposing dial needle, and then knitting with two consecutive dial needles;

at a second feeder, repeating a process of welting with one cylinder needle, knitting with two consecutive opposing dial needles, knitting with two consecutive opposing cylinder needles, and then welting with one opposing dial needle;

at a third feeder, repeating a process of knitting with one cylinder needle, and then welting with one cylinder needle;

at a fourth feeder, repeating a process of knitting with one dial needle, knitting with two consecutive opposing cylinder needles, welting with one opposing dial needle, and then knitting with one dial needle;

at a fifth feeder, repeating a process of knitting with one cylinder needle, welting with one opposing dial needle, knitting with two consecutive dial needles, and then knitting with one opposing cylinder needle;

at a sixth feeder, repeating a process of knitting with one cylinder needle, and then welting with one cylinder needle;

at a seventh feeder, performing the same process as at the second feeder;

at an eighth feeder, performing the same process as at the first feeder;

at a ninth feeder, performing the same process as at the third feeder;

at a tenth feeder, performing the same process as at the fifth feeder;

at an eleventh feeder, performing the same process as at the fourth feeder;

at a twelfth feeder, performing the same process as at the sixth feeder; and thereafter repeating above processes in a feeder (wale) direction.

In the present invention, the "background structure" is a plain part of the fabric.

In this method, at the third feeder, the sixth feeder, the ninth feeder, and the twelfth feeder, dial needles can be selected in place of the cylinder needles.

Preferably, a jacquard pattern is formed on a dial side at the third feeder, the sixth feeder, the ninth feeder, and the twelfth feeder, and a blister pattern is formed on a cylinder side at the other feeders Also, preferably, lay-in yarn is inserted between the first feeder and the second feeder, between the fourth feeder and the fifth feeder, between the seventh feeder and the eighth feeder, and between the tenth feeder and the eleventh feeder.

Furthermore, preferably, a ratio of the number of stitches between the jacquard pattern and the blister pattern in the jacquard structure is 1:2.

The present invention also includes a fabric produced with the above method. Regarding the jacquard fabric for a mattress ticking according to the present invention, the background structure, which is a plain part, and the jacquard structure, which is a pattern part, are mixed in one fabric.

According to the present invention, as a result of employing an irregular twill pattern as a background knitting structure serving as a base, a stretchable fabric that has a soft texture, a tight knitting structure, and similar strength to woven fabric is obtained. In addition, by inserting a jacquard pattern using bright yarn on a front surface and a blister pattern corresponding to the jacquard pattern on a back surface, a glossy jacquard pattern and a tubular blister pattern are obtained respectively on the front surface and the back surface, and a fabric that is most suitable for a mattress ticking with a good design is obtained.

BRIEF DESCRIPTION OF THE DRAWINGS

FIG. 1A is an exploded fabric diagram showing a background structure in Embodiment 1.

FIG. 2A is an expanded pattern diagram showing the background structure in Embodiment 1.

FIG. 2B is an expanded pattern diagram showing the jacquard structure in Embodiment 1.

FIG. 4A is an exploded fabric diagram showing a background structure in Comparative Example 1.

FIG. 5A is an expanded pattern diagram showing the background structure in Comparative Example 1.

FIG. 5B is an expanded pattern diagram showing the jacquard structure in Comparative Example 1.

FIG. 6A is an exploded fabric diagram showing a background structure in Comparative Example 2.

FIG. 6B is an exploded fabric diagram showing a jacquard structure in Comparative Example 2.

FIG. 7A is an expanded pattern diagram showing the background structure in Comparative Example 2.

FIG. 7B is an expanded pattern diagram showing the jacquard structure in Comparative Example 2.

DETAILED DESCRIPTION OF THE INVENTION

Figure 1B:
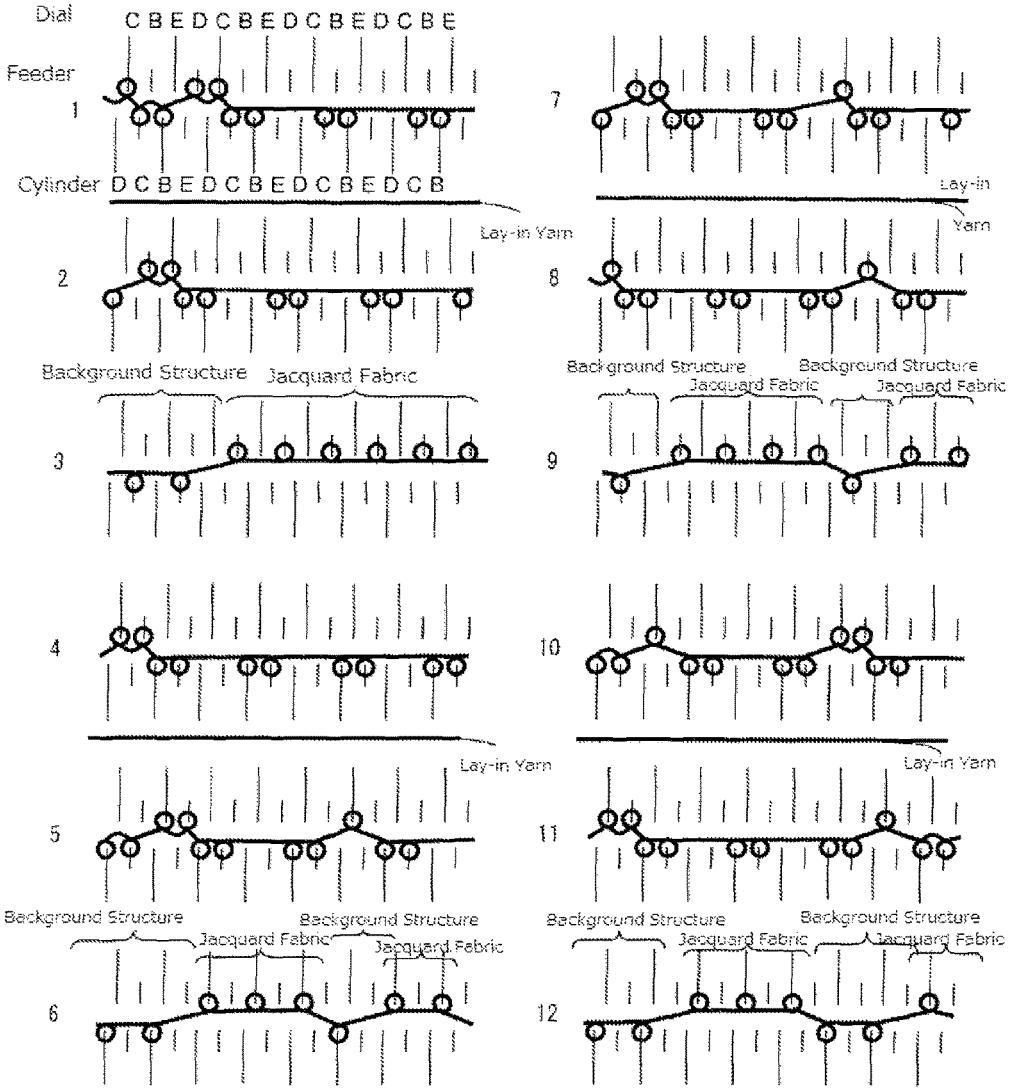
FIG. 1B is an exploded fabric diagram showing a jacquard structure in Embodiment 1.

Hereinafter, an embodiment of the present invention will be described based on the attached drawings.

Embodiment 1

Woven fabric-like Jacquard fabric for mattress ticking

A woven fabric-like jacquard fabric for a mattress ticking in Embodiment 1 is a fabric knitted using a computer-based double knit circular knitting machine (V-LEC6DSIB/36 inches/28 gauges/60 feeders; manufactured by Precision Fukuhara Works, Ltd.). Due to using a double-sided needle selection circular knitting machine, it is possible to create a suitable pattern with computer-based needle selection on a cylinder side and create a suitable pattern with computer-based needle selection on a dial side, and to make a suitable knitting structure in a suitable part by combining the pattern obtained on the cylinder side with the pattern obtained on the dial side.

In the exploded fabric diagrams in FIGS. 1A, 1B, 4A, 4B, 6A, and 6B, the arrangement type of cylinder needles and dial needles is rib gating. For convenience of the description, regarding the cylinder needles, a needle B, a needle C, a needle D, and a needle E are arranged in this order from right to left, and similarly regarding the dial needles, a needle B, a needle C, a needle D, and a needle E are arranged in this order from right to left. These needles are set such that each cylinder needle B is rib gated with respect to the corresponding dial needles E and B.

In Embodiment 1, bright polyester yarn is knitted at feeders 3, 6, 9, 12, and so on, and a desired pattern is formed with a jacquard pattern on the dial side. On the cylinder side at the other feeders, a tubular stitched part of a blister pattern is formed and knitted with spun polyester yarn. Lay-in yarn is inserted as a filling material in the tubular stitched part, and knitting is performed with spun polyester yarn.

FIG. 1A is an exploded fabric diagram showing a background structure in Embodiment 1.

At the first feeder, the cylinder needles B and C knit, and the cylinder needles D and E welt. Meanwhile, the dial needles C and D knit, and the dial needles E and B welt.

At the second feeder, the cylinder needles D and E knit, and the cylinder needles B and C welt. Meanwhile, the dial needles E and B knit, and the dial needles C and D welt.

The lay-in yarn is inserted between verges of the cylinder and the dial, between the first feeder and the second feeder.

At the third feeder, the cylinder needles C and E knit, and the cylinder needles B and D welt. Meanwhile, all dial needles welt.

At the fourth feeder, the cylinder needles B and E knit, and the cylinder needles C and D welt. Meanwhile, the dial needles B and C knit, and the dial needles D and E welt.

At the fifth feeder, the cylinder needles C and D knit, and the cylinder needles B and E welt. Meanwhile, the dial needles D and E knit, and the dial needles B and C welt.

The lay-in yarn is inserted between verges of the cylinder and the dial, between the fourth feeder and the fifth feeder.

At the sixth feeder, the cylinder needles B and D knit, and the cylinder needles C and E welt. Meanwhile, all dial needles welt.

At the seventh feeder, the cylinder needles D and E knit, and the cylinder needles B and C welt. Meanwhile, the dial needles E and B knit, and the dial needles C and D welt.

At the eighth feeder, the cylinder needles B and C knit, and the cylinder needles D and E welt. Meanwhile, the dial needles C and D knit, and the dial needles E and B welt.

The lay-in yarn is inserted between verges of the cylinder and the dial, between the seventh feeder and the eighth feeder.

At the ninth feeder, the cylinder needles C and E knit, and the cylinder needles B and D welt. Meanwhile, all dial needles welt.

At the tenth feeder, the cylinder needles C and D knit, and the cylinder needles B and E welt. Meanwhile, the dial needles D and E knit, and the dial needles B and C welt.

At the eleventh feeder, the cylinder needles B and E knit, and the cylinder needles C and D welt. Meanwhile, the dial needles B and C knit, and the dial needles D and E welt.

The lay-in yarn is inserted between verges of the cylinder and the dial, between the tenth feeder and the eleventh feeder.

At the twelfth feeder, the cylinder needles B and D knit, and the cylinder needles C and E welt. Meanwhile, all dial needles welt.

Thereafter, the knitting method at the first feeder to the twelfth feeder is repeated.

FIG. 1B is an exploded fabric diagram in which a jacquard structure is caused to appear based on the background structure in Embodiment 1.

At the first feeder, the cylinder needles B and C knit, and the cylinder needles D and E welt. Meanwhile, the dial needles C and D knit, and the dial needles E and B welt.

At the second feeder, the cylinder needles D and E knit, and the cylinder needles B and C welt. Meanwhile, the dial needles E and B knit, and the dial needles C and D welt.

The lay-in yarn is inserted between verges of the cylinder and the dial, between the first feeder and the second feeder.

At the third feeder, the cylinder needles opposing dial needles in an area for knitting the jacquard structure welt. In the other area, the cylinder needles C and E knit, and the cylinder needles B and D welt. Meanwhile, the dial needles B and D in an area for knitting the jacquard structure knit. In the other area, all dial needles welt.

At the fourth feeder, the cylinder needles B and E knit, and the cylinder needles C and D welt. Meanwhile, the dial needles B and C knit, and the dial needles D and E welt.

At the fifth feeder, the cylinder needles C and D knit, and the cylinder needles B and E welt. Meanwhile, the dial needles D and E knit, and the dial needles B and C welt.

The lay-in yarn is inserted between verges of the cylinder and the dial, between the fourth feeder and the fifth feeder.

At the sixth feeder, the cylinder needles opposing dial needles in an area for knitting the jacquard structure welt. In the other area, the cylinder needles B and D knit, and the cylinder needles C and E welt. Meanwhile, the dial needles B and D in the area for knitting the jacquard structure knit. In the other area, all dial needles welt.

At the seventh feeder, the cylinder needles D and E knit, and the cylinder needles B and C welt. Meanwhile, the dial needles E and B knit, and the dial needles C and D welt.

At the eighth feeder, the cylinder needles B and C knit, and the cylinder needles D and E welt. Meanwhile, the dial needles C and D knit, and the dial needles E and B welt.

The lay-in yarn is inserted between verges of the cylinder and the dial, between the seventh feeder and the eighth feeder.

At the ninth feeder, the cylinder needles opposing dial needles in an area for knitting the jacquard structure welt. In the other area, the cylinder needles C and E knit, and the cylinder needles B and D welt. Meanwhile, the dial needles B and D in the area for knitting the jacquard structure knit. In the other area, all dial needles welt.

At the tenth feeder, the cylinder needles C and D knit, and the cylinder needles B and E welt. Meanwhile, the dial needles D and E knit, and the dial needles B and C welt.

At the eleventh feeder, the cylinder needles B and E knit, and the cylinder needles C and D welt. Meanwhile, the dial needles B and C knit, and the dial needles D and E welt.

The lay-in yarn is inserted between verges of the cylinder and the dial, between the tenth feeder and the eleventh feeder.

At the twelfth feeder, the cylinder needles opposing dial needles in an area for knitting the jacquard structure welt. In the other area, the cylinder needles B and D knit, and the cylinder needles C and E welt. Meanwhile, the dial needles C and E in the area for knitting the jacquard structure knit. In the other area, all dial needles welt.

Thereafter, the knitting method at the first feeder to the twelfth feeder is repeated.

Note that, although the desired jacquard pattern and blister pattern are caused to appear respectively on the dial side and the cylinder side in the above example, the jacquard pattern and the blister pattern may also be caused to appear respectively on the cylinder side and the dial side. The patterns may be horizontally reversed.

FIG. 2A is an expanded pattern diagram of the fabric knitted based on the background structure in Embodiment 1 as viewed from the cylinder side and the dial side. FIG. 2B is an expanded pattern diagram of the fabric knitted based on the jacquard structure in Embodiment 1 as viewed from the cylinder side and the dial side. Shaded positions of the jacquard structure on the dial side in FIG. 2B correspond to the positions of the jacquard structure shown in FIG. 1B.

Figure 3:
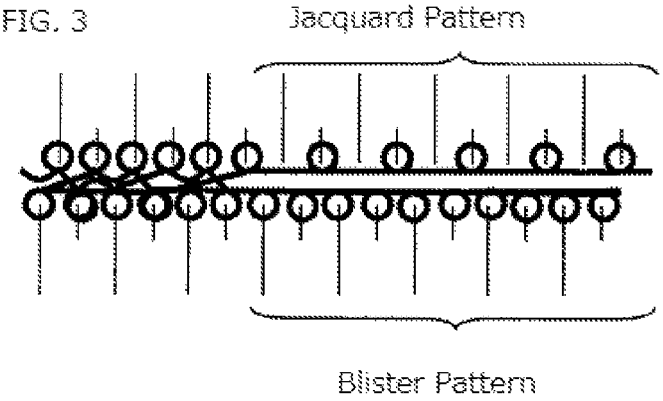
FIG. 3 is an exploded fabric diagram showing a jacquard structure in which three threads at a first feeder to a third feeder in Embodiment 1 are overlaid with one another.

FIG. 3 is an exploded fabric diagram showing a jacquard structure in which three threads at the first feeder to the third feeder in Embodiment 1 are overlaid. The ratio of the number of stitches between the jacquard pattern and the blister pattern in this jacquard structure is 1:2, and the bulge of the tubular stitched part of the blister pattern increases.

In this fabric in Embodiment 1, a phenomenon in which the external appearance of the cloth undulates has been eliminated. The fabric has similar strength to woven fabric due to an irregular twill pattern as shown in the expanded pattern diagram on the dial side, as well as a knitting structure having a strong texture, and is a fabric having a soft texture, which is most suitable for a jacquard fabric for a mattress ticking.

Comparative Example 1

In Comparative Example 1 as well, the circular knitting machine described in Embodiment 1 is used for knitting. In Comparative Example 1, bright polyester yarn is knitted at feeders 2, 6, 10, . . . , and a desired pattern is formed with a jacquard pattern on the dial side. On the cylinder side at the other feeders, a tubular stitched part of a blister pattern is formed and knitted with spun polyester yarn. Lay-in yarn is inserted to serve as a filling material in the tubular stitched part, and spun polyester yarn is used thereas.

FIG. 4A is an exploded fabric diagram at the time of knitting a background structure in Comparative Example 1.

At the first feeder, the cylinder needles B and D knit, and the cylinder needles C and E welt. Meanwhile, all dial needles knit.

At the second feeder, the cylinder needles B and D knit, and the cylinder needles C and E welt. Meanwhile, all dial needles welt.

The lay-in yarn is inserted between verges of the cylinder and the dial, between the first feeder and the second feeder.

At the third feeder, the cylinder needles C and E knit, and the cylinder needles B and D welt. Meanwhile, all dial needles knit.

At the fourth feeder, the cylinder needles C and E knit, and the cylinder needles B and D welt. Meanwhile, all dial needles welt.

Thereafter, the knitting method at the first feeder to the fourth feeder is repeated.

Figure 4B:
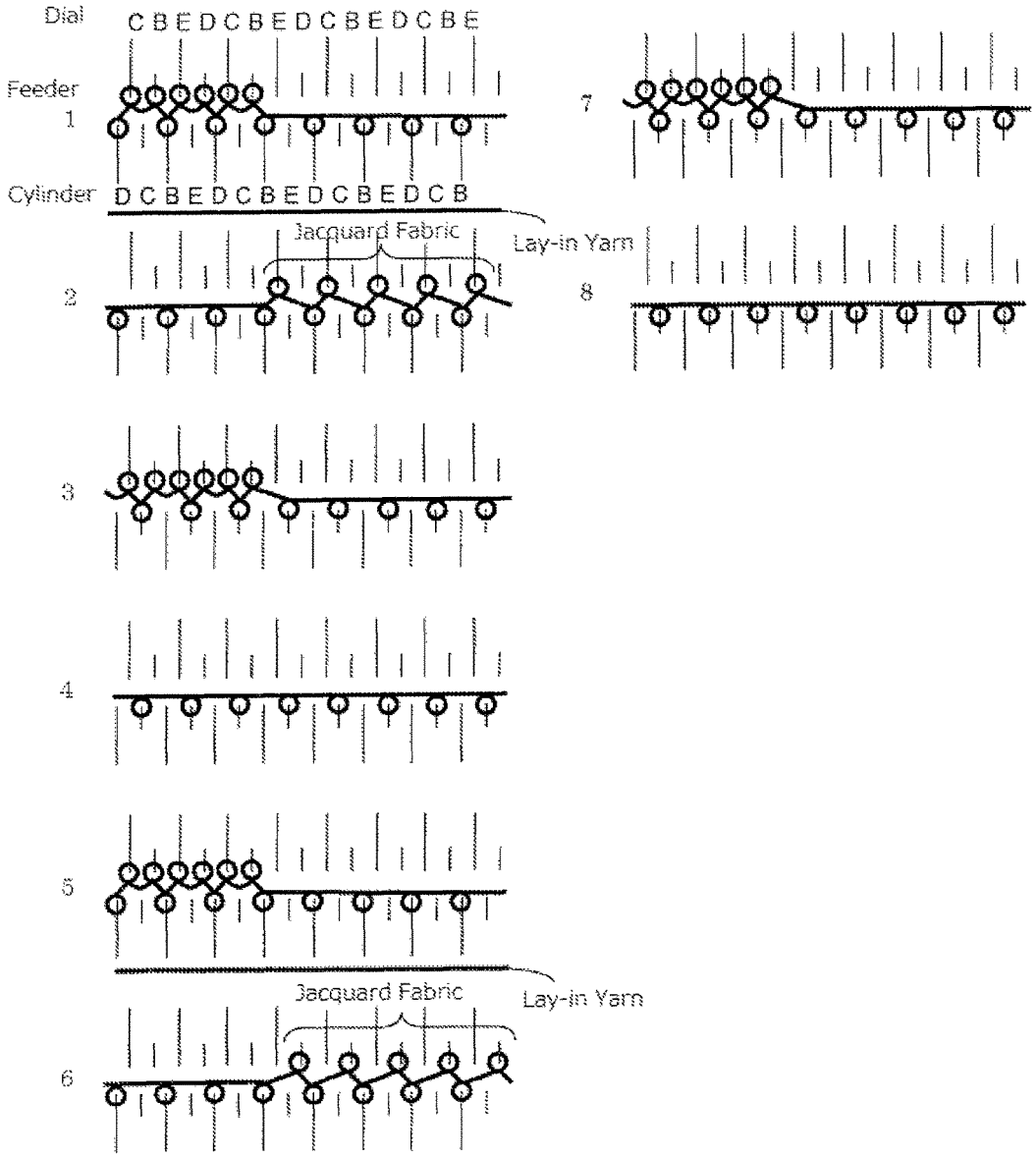
FIG. 4B is an exploded fabric diagram showing a jacquard structure in Comparative Example 1.

FIG. 4B is an exploded fabric diagram in which a jacquard structure is caused to appear based on the background structure in Comparative Example 1.

At the first feeder, the cylinder needles B and D knit, and the cylinder needles C and E welt. Meanwhile, the dial needles in an area for knitting the jacquard structure at the second feeder welt, and all the other dial needles knit.

At the second feeder, the cylinder needles B and D knit, and the cylinder needles C and E welt. Meanwhile, the dial needles C and E in an area for knitting the jacquard structure knit, and all the other dial needles welt.

The lay-in yarn is inserted between verges of the cylinder and the dial, between the first feeder and the second feeder.

At the third feeder, the cylinder needles C and E knit, and the cylinder needles B and D welt. Meanwhile, the dial needles in the area for knitting the jacquard structure at the second feeder welt, and all other dial needles knit.

At the fourth feeder, the cylinder needles C and E knit, and the cylinder needles B and D welt. Meanwhile, all dial needles welt.

At the fifth feeder, the cylinder needles B and D knit, and the cylinder needles C and E welt. Meanwhile, the dial needles in an area for knitting the jacquard structure at the sixth feeder welt, and all the other dial needles knit.

At the sixth feeder, the cylinder needles B and D knit, and the cylinder needles C and E welt. Meanwhile, the dial needles B and D in the area for knitting the jacquard structure knit, and all the other dial needles welt.

The lay-in yarn is inserted between verges of the cylinder and the dial, between the fifth feeder and the sixth feeder.

At the seventh feeder, the cylinder needles C and E knit, and the cylinder needles B and D welt. Meanwhile, the dial needles in the area for knitting the jacquard structure at the sixth feeder welt, and all the other dial needles knit.

At the eighth feeder, the cylinder needles C and E knit, and the cylinder needles B and D welt. Meanwhile, all dial needles welt.

Thereafter, the knitting method at the first feeder to the eighth feeder is repeated.

FIG. 5A is an expanded pattern diagram of the fabric knitted based on the background structure in Comparative Example 1 as viewed from the cylinder side and the dial side. FIG. 5B is an expanded pattern diagram of the fabric knitted based on the jacquard structure in Comparative Example 1 as viewed from the cylinder side and the dial side.

In this fabric in Comparative Example 1, a phenomenon in which the external appearance of the cloth undulates has occurred, and the fabric is not suitable for a jacquard fabric for a mattress ticking.

Comparative Example 2

In Comparative Example 2 as well, the circular knitting machine described in Embodiment 1 is used for knitting. In Comparative Example 2, bright polyester yarn is knitted at feeders 2, 6, 10, . . . , and a desired pattern is formed with a jacquard pattern on the dial side. On the cylinder side at the other feeders, a tubular stitched part of a blister pattern is formed and knitted with spun polyester yarn. Lay-in yarn is inserted to serve as a filling material in the tubular stitched part, and spun polyester yarn is used thereas.

FIG. 6A is an exploded fabric diagram at the time of knitting a background structure in Comparative Example 2.

At the first feeder, the cylinder needles B knit, and the cylinder needles C, D, and E welt. Meanwhile, the dial needles D and E knit, and the dial needles B and C welt.

At the second feeder, the cylinder needles B knit, and the cylinder needles C, D, and E welt. Meanwhile, the dial needles B and C knit, and the dial needles D and E welt.

The lay-in yarn is inserted between verges of the cylinder and the dial, between the first feeder and the second feeder.

At the third feeder, the cylinder needles B, C, and D knit, and the cylinder needles E welt. Meanwhile, all dial needles welt.

At the fourth feeder, the cylinder needles E knit, and the cylinder needles B, C, and D welt. Meanwhile, the dial needles C and D knit, and the dial needles B and E welt.

At the fifth feeder, the cylinder needles E knit, and the cylinder needles B, C, and D welt. Meanwhile, the dial needles B and E knit, and the dial needles C and D welt.

The lay-in yarn is inserted between verges of the cylinder and the dial, between the fourth feeder and the fifth feeder.

At the sixth feeder, the cylinder needles B, C, and E knit, and the cylinder needles D welt. Meanwhile, all dial needles welt.

At the seventh feeder, the cylinder needles D knit, and the cylinder needles B, C, and E welt. Meanwhile, the dial needles B and C knit, and the dial needles D and E welt.

At the eighth feeder, the cylinder needles D knit, and the cylinder needles B, C, and E welt. Meanwhile, the dial needles D and E knit, and the dial needles B and C welt.

The lay-in yarn is inserted between verges of the cylinder and the dial, between the seventh feeder and the eighth feeder.

At the ninth feeder, the cylinder needles B, D, and E knit, and the cylinder needles C welt. Meanwhile, all dial needles welt.

At the tenth feeder, the cylinder needles C knit, and the cylinder needles B, D, and E welt. Meanwhile, the dial needles B and E knit, and the dial needles C and D welt.

At the eleventh feeder, the cylinder needles C knit, and the cylinder needles B, D, and E welt. Meanwhile, the dial needles C and D knit, and the dial needles B and E welt.

The lay-in yarn is inserted between verges of the cylinder and the dial, between the tenth feeder and the eleventh feeder.

At the twelfth feeder, the cylinder needles C, D, and E knit, and the cylinder needles B welt. Meanwhile, all dial needles welt.

Thereafter, the knitting method at the first feeder to the twelfth feeder is repeated.

FIG. 6B is an exploded fabric diagram in which a jacquard structure is caused to appear based on the background structure in Comparative Example 2.

At the first feeder, in an area for knitting the jacquard structure at the previous feeder, the cylinder needles B and D knit, and the cylinder needles C and E welt. In the other area, the cylinder needles B knit, and the cylinder needles C, D, and E welt. Meanwhile, the dial needles in the area for knitting the jacquard structure at the previous feeder welt. In the other area, the dial needles D and E knit, and the dial needles B and C welt.

At the second feeder, in an area for knitting the jacquard structure at the third feeder, the cylinder needles C and E knit, and the cylinder needles B and D welt. In the other area, the cylinder needles B knit, and the cylinder needles C, D, and E welt. Meanwhile, the dial needles in the area for knitting the jacquard structure at the third feeder welt. In the other area, the dial needles B and C knit, and the dial needles D and E welt.

The lay-in yarn is inserted between verges of the cylinder and the dial, between the first feeder and the second feeder.

At the third feeder, in the area for knitting the jacquard structure, the cylinder needles C and E knit, and the cylinder needles B and D welt. In the other area, the cylinder needles B, C, and D knit, and the cylinder needles E welt. Meanwhile, in the area for knitting the jacquard structure, the dial needles B and D knit, and the dial needles C and E welt. All the other dial needles welt.

At the fourth feeder, in the area for knitting the jacquard structure at the third feeder, the cylinder needles C and E knit, and the cylinder needles B and D welt. In the other area, the cylinder needles E knit, and the cylinder needles B, C, and D welt. Meanwhile, the dial needles in the area for knitting the jacquard structure at the third feeder welt. In the other area, the dial needles C and D knit, and the dial needles B and E welt.

At the fifth feeder, in an area for knitting the jacquard structure at the sixth feeder, the cylinder needles B and D knit, and the cylinder needles C and E welt. In the other area, the cylinder needles E knit, and the cylinder needles B, C, and D welt. Meanwhile, the dial needles in the area for knitting the jacquard structure at the sixth feeder welt. In the other area, the dial needles B and E knit, and the dial needles C and D welt.

The lay-in yarn is inserted between verges of the cylinder and the dial, between the fourth feeder and the fifth feeder.

At the sixth feeder, in the area for knitting the jacquard structure, the cylinder needles B and D knit, and the cylinder needles C and E welt. In the other area, the cylinder needles B, C, and E knit, and the cylinder needles D welt. Meanwhile, in the area for knitting the jacquard structure, the dial needles C and E knit, and the dial needles B and D welt. All the other dial needles welt.

At the seventh feeder, in the area for knitting the jacquard structure at the sixth feeder, the cylinder needles B and D knit, and the cylinder needles C and E welt. In the other area, the cylinder needles D knit, and the cylinder needles B, C, and E welt. Meanwhile, the dial needles in the area for knitting the jacquard structure at the sixth feeder welt. In the other area, the dial needles B and C knit, and the dial needles D and E welt.

At the eighth feeder, in an area for knitting the jacquard structure at the ninth feeder, the cylinder needles C and E knit, and the cylinder needles B and D welt. In the other area, the cylinder needles D knit, and the cylinder needles B, C, and E welt. Meanwhile, the dial needles in the area for knitting the jacquard structure at the ninth feeder welt. In the other area, the dial needles D and E knit, and the dial needles B and C welt.

The lay-in yarn is inserted between verges of the cylinder and the dial, between the seventh feeder and the eighth feeder.

At the ninth feeder, in the area for knitting the jacquard structure, the cylinder needles C and E knit, and the cylinder needles B and D welt. In the other area, the cylinder needles B, D, and E knit, and the cylinder needles C welt. Meanwhile, in the area for knitting the jacquard structure, the dial needles B and D knit, and the dial needles C and E welt. All the other dial needles welt.

At the tenth feeder, in the area for knitting the jacquard structure at the ninth feeder, the cylinder needles C and E knit, and the cylinder needles B and D welt. In the other area, the cylinder needles C knit, and the cylinder needles B, D, and E welt. Meanwhile, the dial needles in the area for knitting the jacquard structure at the ninth feeder welt. In the other area, the dial needles B and E knit, and the dial needles C and D welt.

At the eleventh feeder, in an area for knitting the jacquard structure at the twelfth feeder, the cylinder needles B and D knit, and the cylinder needles C and E welt. In the other area, the cylinder needles C knit, and the cylinder needles B, D, and E welt. Meanwhile, the dial needles in an area for knitting the jacquard structure at the twelfth feeder welt. In the other area, the dial needles C and D knit, and the dial needles B and E welt.

The lay-in yarn is inserted between verges of the cylinder and the dial, between the tenth feeder and the eleventh feeder.

At the twelfth feeder, in the area for knitting the jacquard structure, the cylinder needles B and D knit, and the cylinder needles C and E welt. In the other area, the cylinder needles C, D, and E knit, and the cylinder needles B welt. Meanwhile, the dial needles C and E in the area for knitting the jacquard structure knit. In the other area, all dial needles welt.

Thereafter, the knitting method at the first feeder to the twelfth feeder is repeated.

FIG. 7A is an expanded pattern diagram of the fabric knitted based on the background structure in Comparative Example 2 as viewed from the cylinder side and the dial side. FIG. 7B is an expanded pattern diagram of the fabric knitted based on the jacquard structure in Comparative Example 2 as viewed from the cylinder side and the dial side.

This fabric in Comparative Example 2 has a considerably course texture, and is not suitable for a jacquard fabric for a mattress ticking.

Lastly, the evaluation of the fabric in Embodiment 1 and the fabrics in Comparative Examples 1 and 2 is shown in the following table.

TABLE 1

| | The waviness of the fabric | Handle and touch |
|---|---|---|
| Embodiment 1 | Improved the waviness of the fabric Good | More rigid structure Good |
| Comparative Example 1 | Very wavy Not good | Good |
| Comparative Example 2 | Improved the waviness of the fabric Good | Quite coarse Not good |

What is claimed is:

1. A method for producing a background structure in a jacquard fabric for a mattress ticking using a double-sided needle selection circular knitting machine of a rib gating type, the method by which a suitable pattern is created by means of computer-based needle selection on a cylinder side, a suitable pattern is also created by means of computer-based needle selection on a dial side, and a suitable knitting structure is made in a suitable part by combining the pattern obtained on the cylinder side with the pattern obtained on the dial side, the method comprising:

in a course direction from a needle serving as a reference, at a first feeder, repeating a process of knitting with two consecutive cylinder needles, welting with one opposing dial needle, and then knitting with two consecutive dial needles;

at a second feeder, repeating a process of welting with one cylinder needle, knitting with two consecutive opposing dial needles, knitting with two consecutive opposing cylinder needles, and then welting with one opposing dial needle;

at a third feeder, repeating a process of knitting with one cylinder needle, and then welting with one cylinder needle;

at a fourth feeder, repeating a process of knitting with one dial needle, knitting with two consecutive opposing cylinder needles, welting with one opposing dial needle, and then knitting with one dial needle;

at a fifth feeder, repeating a process of knitting with one cylinder needle, welting with one opposing dial needle, knitting with two consecutive dial needles, and then knitting with one opposing cylinder needle;

at a sixth feeder, repeating a process of knitting with one cylinder needle, and then welting with one cylinder needle;

at a seventh feeder, performing the same process as at the second feeder;

at an eighth feeder, performing the same process as at the first feeder;

at a ninth feeder, performing the same process as at the third feeder;

at a tenth feeder, performing the same process as at the fifth feeder;

at an eleventh feeder, performing the same process as at the fourth feeder;

at a twelfth feeder, performing the same process as at the sixth feeder; and thereafter repeating above processes in a feeder (wale) direction.

2. The method for producing a background structure in a jacquard fabric for a mattress ticking according to claim 1, wherein at the third feeder, the sixth feeder, the ninth feeder, and the twelfth feeder, dial needles are selected in place of the cylinder needles.

3. The method for producing a jacquard structure in a jacquard fabric for a mattress ticking according to claim 1, comprising:

forming a jacquard pattern on a dial side at the third feeder, the sixth feeder, the ninth feeder, and the twelfth feeder, and forming a blister pattern on a cylinder side at the other feeders.

4. The method for producing a jacquard structure in a jacquard fabric for a mattress ticking according to claim 2, comprising:

forming a jacquard pattern on a cylinder side at the third feeder, the sixth feeder, the ninth feeder, and the twelfth feeder, and forming a blister pattern on a dial side at the other feeders.

5. The method for producing a jacquard structure in a jacquard fabric for a mattress ticking according to claim 3, wherein a ratio of the number of stitches between the jacquard pattern and the blister pattern is 1:2.

6. The method for producing a background structure in a jacquard fabric for a mattress ticking according to claim 1, wherein a ratio of the number of stitches between the jacquard pattern and the blister pattern is 1:2.

7. The method for producing a background structure in a jacquard fabric for a mattress ticking according to claim 2, wherein a ratio of the number of stitches between the jacquard pattern and the blister pattern is 1:2.

8. The method for producing a jacquard fabric for a mattress ticking according to claim 3, further comprising:

inserting lay-in yarn between the first feeder and the second feeder, between the fourth feeder and the fifth feeder, between the seventh feeder and the eighth feeder, and between the tenth feeder and the eleventh feeder.

9. A jacquard fabric for a mattress ticking obtained by the method according to claim 1.

10. The method for producing a jacquard structure in a jacquard fabric for a mattress ticking according to claim 4, wherein a ratio of the number of stitches between the jacquard pattern and the blister pattern is 1:2.

11. The method for producing a jacquard fabric for a mattress ticking according to claim 4, further comprising:

inserting lay-in yarn between the first feeder and the second feeder, between the fourth feeder and the fifth feeder, between the seventh feeder and the eighth feeder, and between the tenth feeder and the eleventh feeder.

12. The method for producing a jacquard fabric for a mattress ticking according to claim 6, further comprising:

inserting lay-in yarn between the first feeder and the second feeder, between the fourth feeder and the fifth feeder, between the seventh feeder and the eighth feeder, and between the tenth feeder and the eleventh feeder.

13. The method for producing a jacquard fabric for a mattress ticking according to claim 7, further comprising:

inserting lay-in yarn between the first feeder and the second feeder, between the fourth feeder and the fifth feeder, between the seventh feeder and the eighth feeder, and between the tenth feeder and the eleventh feeder.

14. A jacquard fabric for a mattress ticking obtained by the method according to claim 2.

15. A jacquard fabric for a mattress ticking obtained by the method according to claim 3.

16. A jacquard fabric for a mattress ticking obtained by the method according to claim 4.

17. A jacquard fabric for a mattress ticking obtained by the method according to claim 5.

18. A jacquard fabric for a mattress ticking obtained by the method according to claim 6.

19. A jacquard fabric for a mattress ticking obtained by the method according to claim 7.

20. A jacquard fabric for a mattress ticking obtained by the method according to claim 8.

* * * * *